United States Patent [19]

Hofmann

[11] Patent Number: 4,694,215

[45] Date of Patent: Sep. 15, 1987

[54] COMPACT, SINGLE-ENDED FLUORESCENT LAMP WITH FILL VAPOR PRESSURE CONTROL

[75] Inventor: Dieter Hofmann, Augsburg, Fed. Rep. of Germany

[73] Assignee: Patent-Treuhand Gesellschaft fur elektrische Gluhlampen mbH, Munich, Fed. Rep. of Germany

[21] Appl. No.: 771,986

[22] Filed: Sep. 3, 1985

[30] Foreign Application Priority Data

Sep. 5, 1984 [DE] Fed. Rep. of Germany ..... 3432675

[51] Int. Cl.[4] ..... H01J 61/52; H01J 17/28

[52] U.S. Cl. ..... 313/44; 313/493; 315/53

[58] Field of Search ..... 313/44, 493, 318; 315/53, 58, 62

[56] References Cited

U.S. PATENT DOCUMENTS

| | | | |
|---|---|---|---|
| 4,300,073 | 11/1981 | Skwirut | 313/493 X |
| 4,503,358 | 3/1985 | Kamei et al. | 313/493 X |
| 4,530,710 | 7/1985 | Dullea et al. | 313/493 X |

*Primary Examiner*—Palmer C. DeMeo
*Assistant Examiner*—Sandra L. O'Shea
*Attorney, Agent, or Firm*—Frishauf, Holtz, Goodman & Woodward

[57] ABSTRACT

To improve the stability of operation of a compact, single-ended fluorescent lamp under "base down" operation, and provide for a predetermined temperature "cold spot" defining the vapor pressure within the fluorescent lamp, and particularly for a lamp having four parallel tubular portions which are interconnected to form a continuous discharge vessel, one of the tubular portions which does not carry an electrode has a small tube or stub element (16) connected into a pinch seal terminating the particular tubular element, the stub element extending below the pinch seal and into the base of the lamp. The lamp is formed with two vertically arranged openings to provide for passage of cooling air, by thermal convection, from a lower opening (17), past the cooling tube or stub (16) and to an upper outlet vent opening (19). A socket, in which the lamp may be inserted, is preferably likewise formed with openings to permit passage of air thereinto, from a lower side to an upper opening which matches the alignment of the opening in the lamp base. Combination of such a lamp, with a lamp base with lamp operating circuit components, is readily possible, in which case the lamp operating circuit components are preferably located within an adapter of a housing element which includes an opening with a guide tube to guide cool air leading to the cooling tube. Under "base down" operation, mercury within the fill of the fluorescent lamp may condense and flow down, to collect as a mercury droplet in the cooling tube or stub, to thereby establish the vapor pressure within the discharge vessel.

14 Claims, 7 Drawing Figures

COMPACT, SINGLE-ENDED FLUORESCENT LAMP WITH FILL VAPOR PRESSURE CONTROL

REFERENCE TO RELATED PATENTS, assigned to the assignee of the present application, the disclosure of which is hereby incorporated by reference U.S. Pat. No. 4,481,442
U.S. Pat. No. 4,375,607
U.S. Ser. No. 669,804, filed Nov. 9, 1984, et al.

The present invention relates to a compact low-pressure discharge lamp forming a fluorescent lamp, having a single-ended discharge vessel, formed of at least two parallel tubes, the ends of which have electrodes pinch-sealed or press-sealed therein. The discharge vessel retains a fill of mercury and at least one noble gas, and is located in a base.

BACKGROUND

Single-ended fluorescent lamps with two or more parallel tubes located adjacent each other are described in U.S. Pat. Nos. 4,481,442 and 4,375,607. A single base is located at the end portions of the respective legs. The cross or connecting portions of the discharge tubes are formed to provide for enhanced heat dissipation. In operation of the lamp, the ends of the discharge vessel remote from the electrodes form cool zones or cool spots, on which mercury of the fill of the lamps may condense.

The temperature of the coldest spot in the discharge vessel determines the mercury vapor pressure in operation of the lamp. The mercury vapor pressure is determinative of the light output from the lamp. Compact low-pressure discharge lamps as described in the referenced patents, when operated in vertical "base up" position, i.e. with the base being upwardly of the connecting corner forming the cool spots in the lamp, or in horizontal position, with the base being laterally of the cool spots, will result in an optimum temperature at the cooling spot of about 45° C. The discharge within the lamp is non-varying and the light output is effectively constant or even.

If lamps of this type are operated vertically with the base being downwardly, that is, in "base down" position, the cooling zones in the cross portions of the lamp may reach a temperature which deviates from the optimum temperature of operation of the lamp. The temperature may rise. The light output for the lamp is thereby reduced. Vertical operation of the lamp, if the connecting portions or cool zones are substantially cooled by an ambient air current or air stream, however, may lead to formation of drops of mercury which condenses at the cooling spots or zones, resulting in variation or undulation of light output, and interference with smooth and uniform operation of the discharge therein. It is possible, in some conditions of position of the lamp, that condensing mercury drops directly on one or the other of the electrodes which, if such drops persist, may lead to damage of the electrodes. The dropping mercury, which is continuously vaporized by the discharge within the tube, that is, the mercury which continuously recondenses, may, under some operating conditions, even lead to flaking or removal of fluorescent material with which the inside of the discharge vessel is coated.

It has previously been proposed to provide uniform cooling to a fluorescent lamp - see U.S. Pat. No. 4,375,607—by surrounding a single-ended fluorescent lamp with an outer bulb, spaced from the discharge vessel itself. The discharge vessel is located wholly outside of the base and is formed by a U-shaped tube which is bent three times, and includes a cooling tip, located just above an attachment plate which closes off the base with respect to the discharge vessel. Peripheral slits, and an opening beneath the cooling tip in the attachment plate, together with vent openings in the lower portion of the base and in the bulb in a region remote from the base, permit an air stream within the lamp, that is, air convection therein. The air flows past the cooling tip, and thereby leads to condensation of the mercury at this cooling tip.

The lamp just described requires the outside surrounding bulb to obtain condensation of the mercury in the cooling tip, since the flue effect or thermal duct effect can be obtained only by the outer bulb by insuring sufficient air flow required for condensation of the mercury at the cooling tip. The provision of the outer bulb, however, substantially increases the size of the discharge lamp, which then no longer will be highly compact, and thus cannot be used anymore in various fixtures which are designed specifically for low-pressure compact discharge lamps.

THE INVENTION

It is an object to provide a low-pressure compact discharge lamp which can be universally used and operated in any position, which does not require an outer bulb, and in which maximum light output is obtainable regardless of the operating condition of the lamp. Basically, the lamp may be similar to that described in U.S. Ser. No. 669,804, filed Nov. 9, 1984, KLEIN et al., and have long life.

Briefly, portions of the discharge vessel subject to heating are located in the interior of the base, and the base defines a cooling zone, formed with openings located in such a manner that, when the lamp is operated in "base down" position, air will circulate through the base. In accordance with a feature of the invention, the base is formed with an opening at the bottom or at the side adjacent a bottom region thereof, and a vent opening at the top, so that air can circulate through the base and cool that portion of the discharge vessel which is located within the base.

In accordance with a feature of the invention, and particularly for use with compact fluorescent lamps having a plurality of U-shaped tubes, e.g. two U-shaped tubes adjacent each other, interconnected to form a continuous discharge space, one leg of the two U-shaped tubes, each, carries an electrode, the other leg being electrodeless and being interconnected with an adjacent electroless leg. The electroless legs, or at least one of them, have a small tube or stub press-sealed into the pinch or press at the end of the respective legs, which tube or stub is terminated or tipped off at the bottom - when the lamp is in "base down" position. The tube or stub is located within the stream of air flow through the base to form a definite cooling zone on which mercury may condense. Thus, mercury within the fill of the lamp will drop into that portion of the U-shaped tubes which are electrodeless, so that interference of the discharge by coating of the electrodes with mercury is effectively eliminated.

The lamp has the advantage that it can be operated in any position, "base down", "base up", or "base sideways".

In accordance with a preferred feature of the invention, the discharge vessel is formed of a plurality of parallel, interconnected longitudinal leg portions, forming a continuous discharge space. At least those ends of the longitudinal leg portions which are facing the base, and are located therein, are sealed, for example by a pinch or press seal. This construction, very simply, results in a warmer region within the base which is desirable for air flow therethrough.

To locate the cooling zone truly within the coldest portion of the discharge vessel in operation of the lamp, it is necessary to provide a region which is washed by or surrounded by "cold" air. Thus, the cooling region or zone must be located beneath the warmer portions of the chimney or flue, formed by the base and the openings therein. Preferably, this cooling zone or region is formed by the single-ended, closed tube or tip which is melted into one of the press seals of the longitudinal tube portions, preferably in those longitudinal portions which do not carry electrodes.

The construction is most suitably and simply made such that, upon manufacture of the discharge vessel, a small cooling tube is located in the tube forming the discharge vessel in the region of a press or pinch seal thereof and melt-sealed into the press or pinch seal, and, after manufacture of the lamp, tipping off these tubes or stubs so that they will be closed with respect to the outside. Preferably, the tubes or stubs do not project within the interior of the lamp, but are essentially flush with the press seal, to permit collection of mercury therein, or rundown of mercury which might drip off. Those pinch or press seals which do not carry electrodes already are at a lower temperature than the pinch or press seals which do carry the electrodes and, hence, the additional cooling tubes, providing a base cooling portion, are preferably located in those of the parallel legs which do not carry electrodes.

The chimney or flue effect is most noticeable when the base is formed with at least one air inlet opening and a single air outlet opening which, for example, is located on the upper surface of the base, facing the extending and projecting legs of the discharge vessel. If, for example, two or four parallel legs of the discharge vessel are secured in the base, the air outlet opening is preferably located in the center, that is, between the respective legs of the leg portions of the discharge vessel. In this location, the outlet or vent opening from the base is hidden from view, protected against plugging or contamination, and essentially inaccessible.

Some compact fluorescent lamps are combined with ballasts and additional circuitry to permit direct interchange of the lamps, in standard "Edison" screw lamp sockets. When the base and lamp screw are constructed as a common unit, or as an assembled unit, it is, in accordance with a preferred feature of the invention, desirable to include an air duct in the base-ballast structure which is so arranged that heat generated by the ballast and/or additional starting and similar apparatus does not interfere with air flow within the base, or provide unduly heated air to the base of the lamp.

DRAWINGS

DETAILED DESCRIPTION

Figure 1:
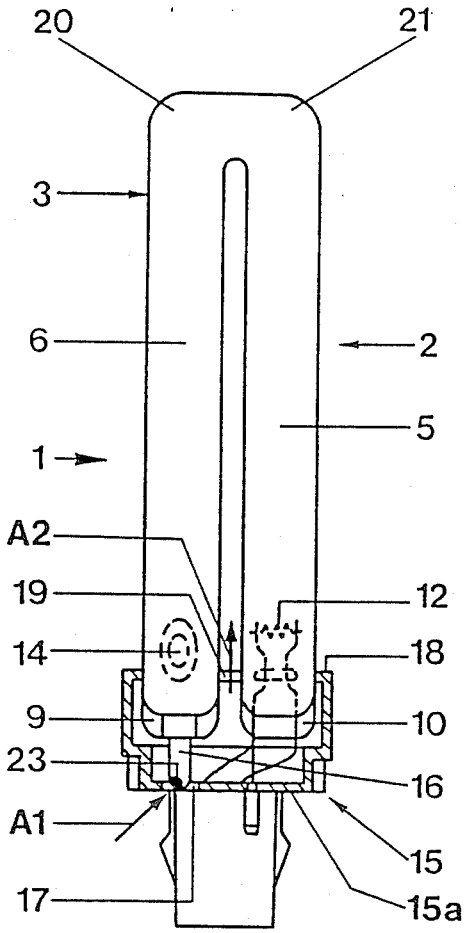
FIG. 1 is a side view, partly in section, of a singleended fluorescent lamp in which the features of the present invention are incorporated.

A compact low-pressure fluorescent lamp 1 (FIGS. 1–3) has a continuous discharge vessel 2 which is assembled of two U-shaped, bent glass tubes 3, 4. The outer diameter of the glass tubes 3, 4 is about 12 mm. The spacing between the longitudinal leg portions 5, 6, 7, 8 (FIG. 3) is about 3 mm. The length of the leg portions 5, 6 is about 10½ cm. It is not necessary that the discharge vessel is formed of two U-bent tubes, connected together; four individual tubes, corresponding to the legs 5, 6; 7, 8 may be used, suitably connected by cross connections, other than a unitary U-bend, as known.

Figure 3:
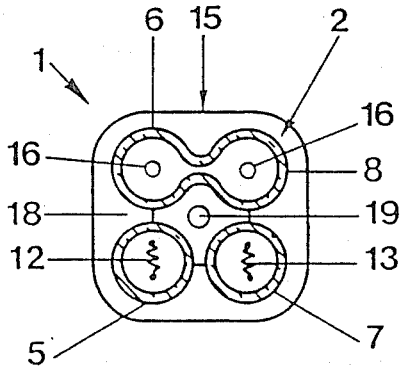
FIG. 3 is a top view of the lamp along the section line III—III.

The free end portions of the longitudinal legs 5, 6; 7, 8 are sealed by pinch seals or press seals 9, 10, 11. The outer pinch or press seals 10, 11 forming the end portions of the discharge vessel each carry an electrode 12, 13 (FIG. 3). The legs 5, 6 and 7, 8, each, form respective pairs 3, 4. The pairs 3, 4 are located, in alignment, such that the two pinch seals 10, 11, with the electrodes 12, 13, are positioned adjacent each other, rather than diagonally, in order to form a discharge path which can be easily interconnected.

The legs of the pairs 3, 4, as well as the connecting portions, are coated at the inside with a suitable fluorescent phosphor.

The compact low-pressure discharge lamp 1 has a hollow base 15, made of plastic material, which is of the standard IES (Illuminating Engineering Society) type G24. The ends of the legs 5, 6; 7, 8 terminated by the pinch seals 9, 10, 11, extend into the base 15 by about 1 cm and are secured therein by a plastic retaining compound or cement.

In accordance with a feature of the invention, the pinch seal 9, which does not carry an electrode, has a cooling tube or stub 16 pinch-sealed or press-sealed therein. The stub or cooling tube 16 has a length of about 9 mm, and an outer diameter of 3 mm. The tube or stub 16 is tipped off at the bottom and extends up to about the lower wall **15*a* of the base 15. The base wall 15*a* of the base 15 is formed with an air inlet opening 17 in the region of the tipped-off tube 16. The upper wall or region 18 of the base, through which the legs 5, 6; 7, 8 of the discharge vessel extend, is formed with a vent or air outlet opening 19. The air outlet opening 19 is located, preferably, at the center of the base 15**.

OPERATION

Upon operation of the lamp 1, mounted "base up", that is, upside-down with respect to the illustration of FIG. 1, or upon operation of the lamp in the position "base sideways", that is, rotated 90° in the plane of FIG. 1, the end portions of the legs 5, 6; 7, 8 remote from the base, that is, in the illustration the corners 20, 21, 22 of the U-shaped tube pairs 3, 4, form a cooling zone on which mercury in the fill of the lamp may condense.

The mercury vapor pressure will control the light output obtainable from the lamp.

If the lamp is operated vertically, "base down", as shown in FIG. 1, the base 15 and the cooling tube or stub 16 will form a cooled zone which will then determine the mercury vapor pressure, and hence the light output available from the lamp. The air inlet opening 17, the vent opening 19, as well as heat generated by the discharge, which is transferred to the pinch seals 9, 10, 11, will cause air circulation - see the arrows A1, A2 through the chamber formed by the hollow base. Air flow will result by thermal convection, due to the chimney or flue effect within the base 15. Consequently, "cold" air, obtained from ambient surroundings, will be continuously supplied to the cooling tube 16.

Within the cooling tube 16, exposed to the air flow from opening 17 and through opening 19, mercury will condense as schematically shown by the mercury droplet 23. The vapor pressure of the condensed mercury will determine the light output from the lamp 1.

In one example, and operating the lamp at 220 V with a suitable lamp operating circuit, such as a ballast or the like, the lamp, with 13 W power consumption, will have a lamp voltage of 98 V and a lamp current of 155 mA.

Figure 4:
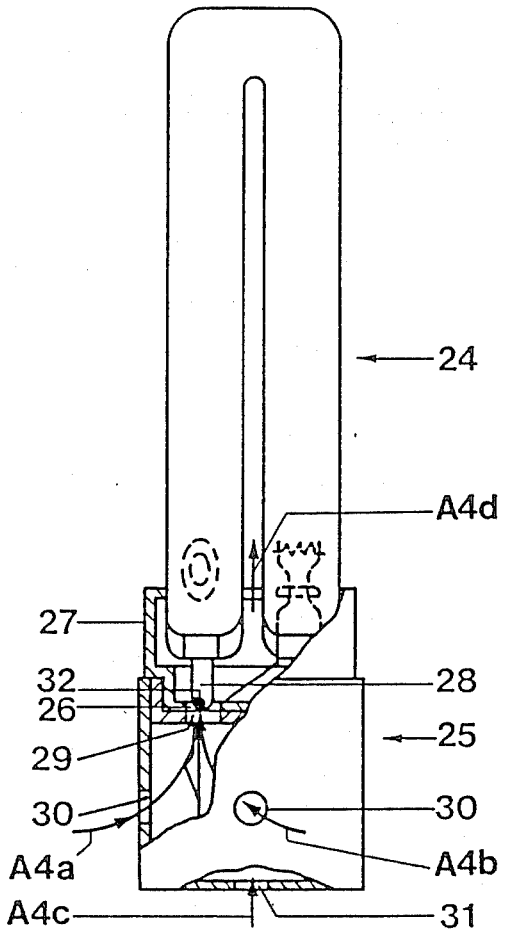
FIG. 4 is a view of the lamp similar to FIG. 1 in which the base is fitted in a socket.

FIG. 4 illustrates the lamp shown in FIG. 1, in which the base 27 is inserted in a socket 25 made of plastic material. The lamp 24 and the base 27 are not described in detail since the construction can be identical to that described in connection with FIG. 1. The inner structure of the socket, including electrical terminals of the socket 25, have been omitted from the drawing for clarity, since they do not form part of the present invention.

In accordance with a feature of the present invention, the socket 25 is formed with an opening 29 which is positioned to match the opening 26 in the bottom of the base 27, with which the cooling tube 28 is in alignment, or into which it may even extend. The socket 25 has four air access openings 30 of, for example, 5 mm each for air flow therethrough as shown by arrows A4*a*, A4*b*, A4*d*. The air inlet openings 30 are uniformly distributed over the circumference of the socket 25. The air outlet or vent opening in the base is similar to that shown in FIG. 1. An additional air inlet opening 31, likewise of about 5 mm diameter, is formed in the bottom wall of the socket 25, to permit air flow in accordance with the arrow A4*c*.

OPERATION

In operation of the lamp "base up", "base sideways", the coolest spots will be at the corners of the U tubes, and any mercury which may condense thereat will be kept away from the electrodes. In operation of the lamp 24 "base down", that is, with the base 27 as illustrated in FIG. 4, ambient "cold" surrounding air is admitted to the socket 25 through the inlet openings 30, 31 and conducted in the socket 25 through the openings 29, 26 to the cooling tube or stub 28. Mercury may condense as shown, schematically, at 32, within the stub, which determines the vapor pressure and hence the light output from the lamp 24.

Figure 2:
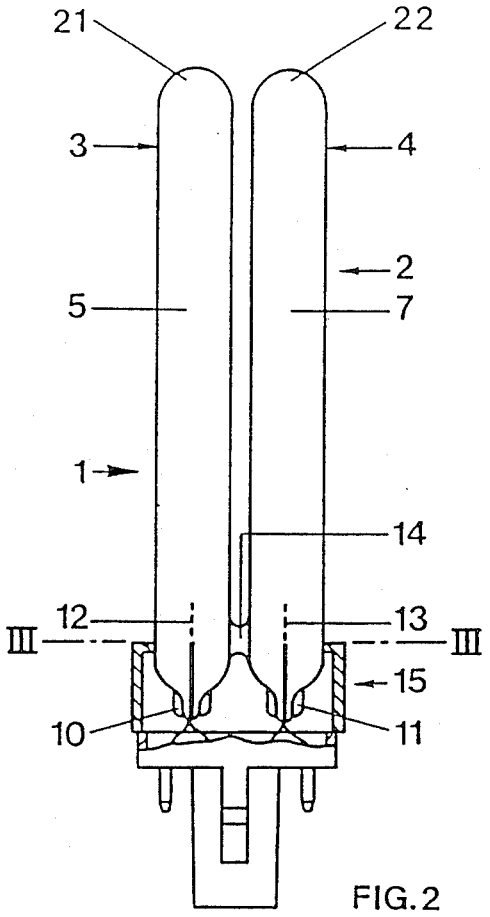
FIG. 2 is a side view, partly in section, of the lamp of FIG. 1, rotated by 90°.
Figure 5:
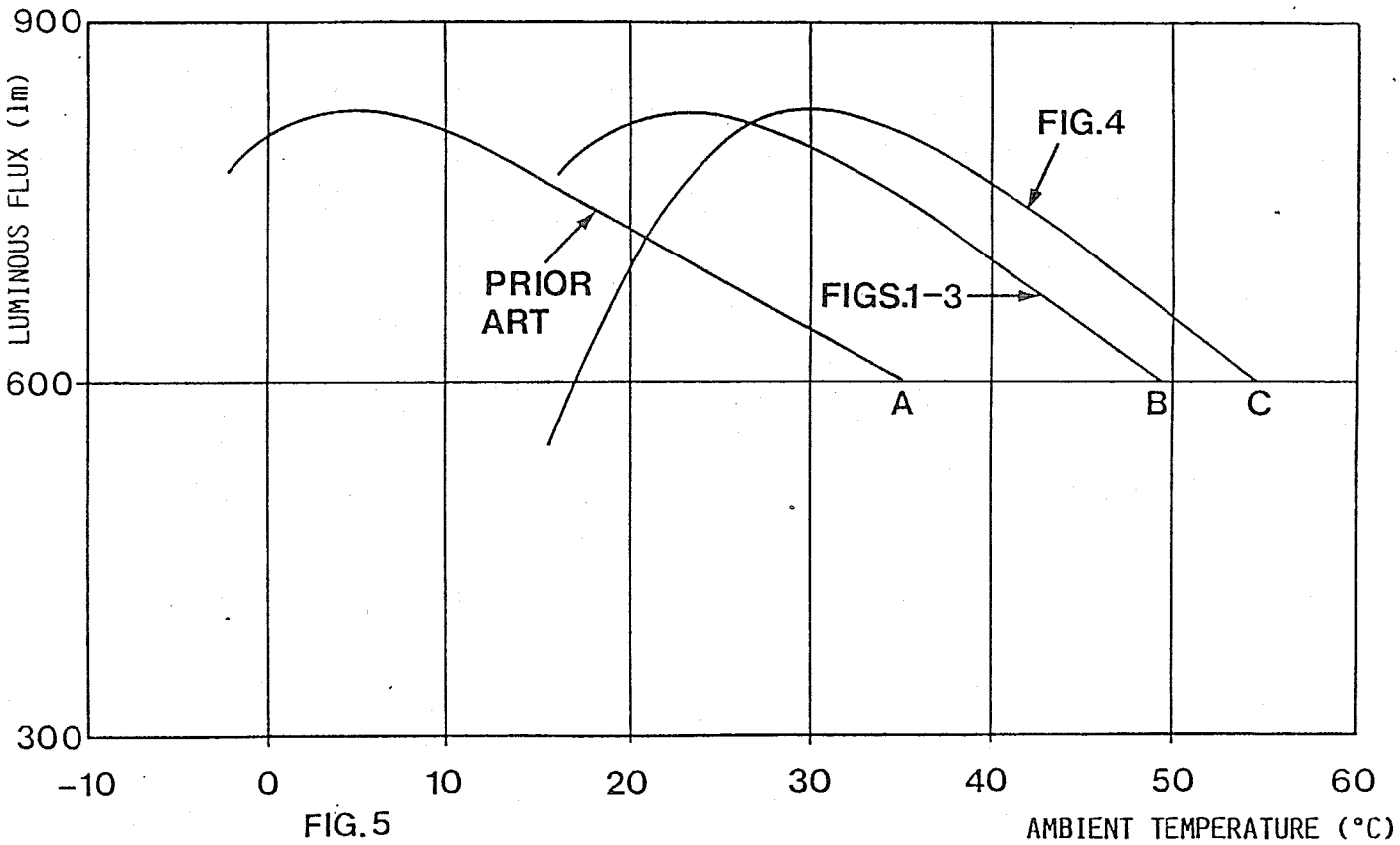
FIG. 5 is a diagram of light output (ordinate) vs. ambient operating temperature (abscissa) of the lamp discharge vessel.

FIG. 5 is a diagram of luminous flux in lumens, that is, generally of light output available from a 13 W (nominal) low-pressure discharge lamp as illustrated in FIGS. 1 to 3, and with a further graph in accordance with the prior art. It is assumed that the lamps are operated in vertical condition, that is, "base down" in a socket as shown in FIG. 4.

Curve A illustrates a lamp without the cooling tube 16, and without vent openings in the base or in the socket. Curve B illustrates operation of a lamp with a cooling tube and vent openings in the base, and located within a socket which does not have the cooling openings 30, 31; curve C illustrates the operation of a lamp with a cooling tube and vent openings in the base as well as in a socket having the air openings 30, 31, that is, in accordance with FIG. 4.

The curves clearly show that low-pressure discharge lamps without a cooling system provide maximum light output at an ambient surrounding temperature of about 5° C. If the cooling system is provided in the base, however, without air passage through the socket, the maximum light output is obtainable at a temperature of about 23° C., which corresponds roughly to usual "room temperature". If additional cooling is provided to conduct air through the socket to the base, maximum light output is obtained at an ambient air temperature of about 30° C.

The "ambient temperature" is the temperature of ambient air in the vicinity of the lamp tubes, or surrounding the lamp. Interior illumination fixtures for compact fluorescent lamps usually are designed for an average room temperature of about 25° C., and, including the fixture lamp shades and covering, if provided, an ambient temperature within the fixture and surrounding the lamp of about 30°. Utilizing the structure of the lamp of the present invention, including the cooling system, thus provides for optimum light output. Without vent openings in the socket, the vented base is primarily suitable for fixtures which do not have any heat retaining structure or shade arrangement, and are eminently suitable for external or general illumination outside of specific fittings.

Figure 6:
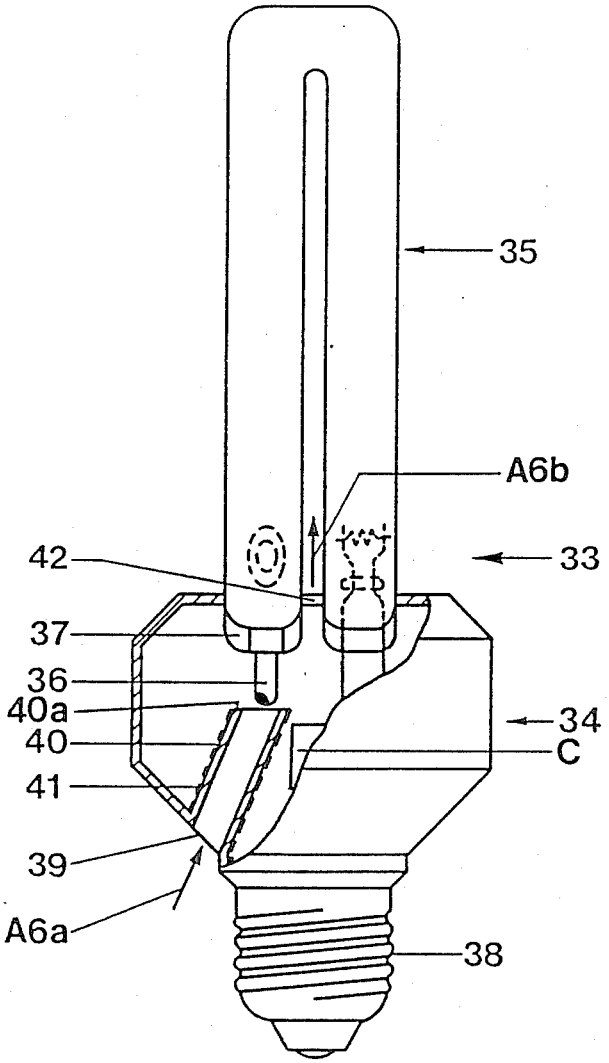
FIG. 6 is a side view, partly in section, similar to FIG. 1, of a lamp in a base constructed to receive operating circuitry for the lamp.

The high light output of the compact fluorescent lamp with low power consumption renders it particularly suitable for indoor illumination; the light output of the 13 W lamp is comparable to that of an ordinary standard service 60 W incandescent lamp. In order to provide for interchangeability of the high-efficiency compact fluorescent lamp with a standard incandescent lamp, and because of its small size, bases which include auxiliary circuits for operation of the fluorescent lamp have been constructed with a standard Edison screw-in termination. FIG. 6 illustrates a lamp 33 in accordance with the present invention having a base 34 made of plastic material to retain and receive the auxiliary operating circuitry C, such as ballast, capacitors and the like, and not specifically shown or described since they can be of standard construction and do not form the subject matter of the present invention. The discharge vessel 35 may be identical to that shown in connection with FIGS. 1 to 3. The assembly of discharge tubes includes at least one cooling tube or stub 36 which is passed through a pinch or press seal 37 of the vessel 35. The base 34 is formed with a standard Edison-27 thread 38 to insert the entire lamp 33 in a standard lamp socket.

In accordance with a feature of the invention, the base 34 is formed with an air inlet opening 39 of, for example, 5 mm diameter. A plastic tube stub 40 of about 5 mm diameter is located inside of the base 34, for example by being molded integrally therewith. The stub 40 extends towards the tip of the cooling tube or stub 36 extending from the press of the lamp 35. The opening 39 and the tube 40 conduct "cold" ambient air to the cooling tube 36, so that, upon "base down" operation of the lamp 33, the "cold spot" within the discharge vessel 35 can be formed at the bottom of the cooling tube 36. Maximum light output in this type of operation can thus be obtained. The tube 40, preferably, is coated at the outside with a heat-reflective coating 41 in order to keep off heat generated by the starting and/or operationg circuitry C for the lamp within the base 34 from the cooling tube 40. The air being led in through the opening 39 and tube 40, after passing around and washing the cooling tube 36, can then pass through an outlet 42 at the upper portion of the base 34. Air flow is indicated by arrows A6*a* and A6*b*.

Figure 7:
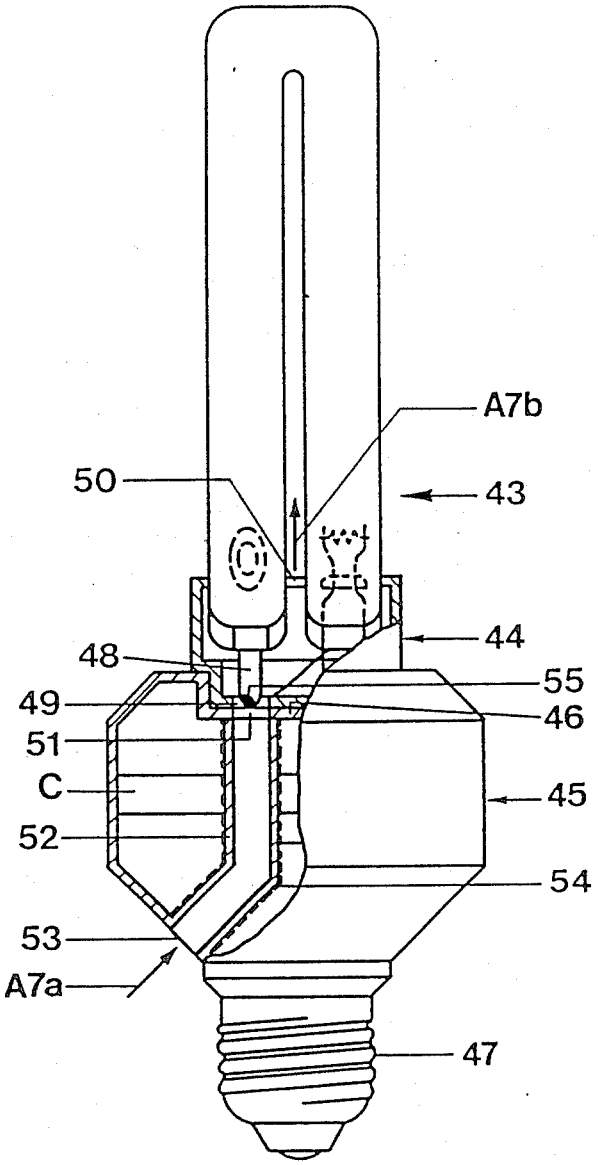
FIG. 7 is a side view, partly in section, similar to FIG. 1, of a single-ended base lamp, in which the base is connected to an adapter to receive operating circuitry for the lamp.

Some structures include a combination of a base with a replacement socket for the lamp. FIG. 7 shows a lamp 43 having a G-24 base 44 of plastic material. An adapter 45 is provided to receive the operating circuitry for the lamp. The adapter 45 has a plastic housing and, at one end thereof, has a socket 46 to receive the G-24 socket 44 of the lamp 43. At the opposite end, the adapter 45 has an Edision E27 screw base portion 47 so that the adapter 45 can be screw-connected in a standard lamp socket. The lamp 43 may be exactly as described in connection with FIGS. 1-3 and includes a cooling tube 48, an inlet opening 49, and an outlet opening 50 in the base 44 of the lamp, for air flow as illustrated by the arrows A7*a* and A7*b*.

The adapter 45 is formed with an opening 51 of about 5 mm diameter opposite the inlet opening 49 in the base 44 of the lamp. The opening 51 is in air flow communication with the tube 52 which terminates at a lower portion of the adapter 45 in an opening 53. The opening 53, as well as the inlet dimension of the tube 52, preferably, are of about 5 mm diameter. The air supply system, thus, can supply continuously ambient air which is "cold" with respect to the operating condition of the lamp to the cooling tube 48. The tube 52 is formed with a heat-reflective coating 54 at the outside thereof in order to separate heat generated by circuitry and circuit components C within the adapter 45, from the air for cooling the lamp cooling tube 48 and, thus, from the cooling system within the base 44. The adapter 45, thus, permits placement of ambient cooled air to wash and surround the cooling tube 48 so that the vapor pressure within the lamp 43, and hence the light output therefrom, will be determined by mercury condensed in, for example, droplet form, at the botton of the tube 48, as schematically shown at 55.

Since the vapor pressure is determined by condensed mercury, it is usually sufficient to form only one of the tube legs 6 or 8 with the cooling tube 16, although both of the legs may be formed with such cooling tubes. The cooling tube or tubes 16 is/are sealed into the end seal or press of the respective legs 6, 8 of the lamp, that is, preferably those which do not carry electrodes.

As best seen in the Figures, the air inlet openings to the lamp base and/or the cooling tube are located asymmetrically with respect to the outline of the respective base - see, for example, FIGS. 1, 4, 7. If the sockets or adapters 25, 45 have symmetrical terminals, the lamp can be inserted reversed 180° with respect to the position shown in FIGS. 4, 7, so that the cooling tubes 28, 48 will then be out of alignment with respect to the openings 29, 51 in the socket or adapter, respectively. The operating conditions for lamp under those conditions will then be as shown in graph B of FIG. 5, that is, with maximum light output at lower ambient temperatures since the enhanced chimney or flue effect, obtained by the socket, will be absent. The engagement of the respective base 27, 44 of the lamps in the adapters or sockets is never so tight that air passage through the inlet openings of the bases is entirely inhibited. Air may still pass through the respective inlet openings although, of course, air passage of the inherently cooler ambient air will be throttled.

Under most conditions, the air flow system in the socket is preferably combined with the air flow system is the base of the lamp as such; the socket, then, must be arranged to provide for air flow - see, for example, the openings 30, 31 (FIG. 4) and tubes 41, 52. These air inlet vent openings must be left free from obstruction upon association in a lamp fixture or in a socket, since air convection is only obtained by providing some air inlet to permit air to flow out of the base.

The socket for the lamp need not have a special air supply if the lamp is intended for use externally of a fixture, for example for external illumination. At low outside temperatures, the temperatures in the vicinity of the legs 5, 6, 7, 8, that is, the actual lamp temperature, will be such that a special cooling position in the base will no longer be necessary—compare curves A and B of FIG. 5.

A base which can be readily rotated axially by 180°, with a suitable socket, permits matching of the lamp alternatively to two different environmental conditions, that is, to environmental conditions having different average temperature ranges. It is only necessary to then provide for the socket an air supply system for a single insertion direction of the base; only in one insertion direction of the base, then, will the air supply system match the air supply system of the socket and thus provide the base with the required ambient cooling air. In the other, reverse direction, the air supply system through the socket will be essentially ineffective, and air flow through the base is substantially reduced or throttled and, under some conditions, for example upon use of a further sealing ring, it may be inhibited entirely.

Different arrangements may be used to inhibit air flow and, depending on use, the air inlet and/or outlet openings for air flow can be plugged; since the air flow is not strong, a small adhesive tab can be provided which can be selectively used in dependence on the installation of the lamp.

The lamp base, or an adapter therefor, may retain various types of circuitry and circuit components C, for example starters, ballasts, power factor correction capacitors, or other circuits, for example including voltage and/or frequency conversion circuits. Such adapters or additional bases will, preferably, be subject to the same air flow conditions as the lamp bases themselves. The adapters or additional bases, thus, must include besides a fitting to receive the lamp base, and a further fitting to insert the adapter in a standard socket, an opening which can be matched with the opening 17 (FIG. 1) of the lamp base, for example by connecting such an opening with one or more ducts within the adapter to provide cooling air to the respective cooling tube. Shielding, with respect to heat radiation, of such air ducts or tubes is desirable, so that as little heat generated in the auxiliary equipment or circuitry within the adapter or adapter base structure is transferred to the cooling air to be conducted to the lamp as possible.

Various changes and modifications may be made, and features described in connection with any one of the embodiments may be used with any of the others, within the scope of the inventive concept. The present invention is not limited to fluorescent lamps of the type shown in the drawings, that is, lamps which use integral U-shaped bent tubes, but also to any other type of low-pressure discharge lamp in which, in general, two or more parallel legs 5, 6, 7, 8 are interconnected to form a discharge vessel having a single continuous discharge space therein. For example, the shape of the bottom wall 15*a* (FIG. 1) may be of various forms and may include the reentrant portion defining the tube 40 (FIG. 6), so that the end wall 40*a* (FIG. 6) will be defined by an inwardly extending stub.

I claim:

1. A compact, single-ended, low-pressure discharge lamp (1, 24, 33, 43) with vapor pressure control regardless of lamp position, having a single base (15, 27, 34, 44);

an internally continuous discharge vessel (2, 35) in form of a plurality of tube legs (5, 6, 7, 8) located close to each other and being closed at opposite ends, one end portion of the tube legs extending into the base and being subjected to heating, said end portions of the tube legs in the base being closed by a pinch or press seal, and secured and retained within the interior of the base;

electrodes (12, 13) press-sealed into two of the end portions of the tube legs; and a fill of mercury and a noble gas within the discharge vessel, wherein a base cooling zone is provided, located within the base, said base cooling zone, in operation of the lamp, and upon positioning of the lamp in "base down" position, being located in the region of the end portions of the discharge vessel, subject to heating, located in the base and comprising a cooling tube or stub (16, 28, 36, 48) pinch or press-sealed in the press seal of at least one of the legs, said cooling tube or stub being open to the interior of the discharge vessel, terminating essentially flush with the pinch or press seal at the inside of the discharge vessel, and being tipped off at a position beyond the pinch or press seal of the respective tube leg to form a projecting cooling tube; and the base has a base wall (15*a*, 14*a* ) formed with an air inlet opening (17, 26, 39) passing therethrough and further formed with an upper region defining an air outlet opening (19, 42, 50), said openings being located to provide for air flow through the base by thermal convection to place said projection cooling tube in a stream of air flow between said air flow openings when the lamp is in "base down" position.

2. A lamp according to claim 1, wherein four parallel interconnected tubes (5, 6, 7, 8) are provided, defining four tube legs; two of the end portions of said tubes within the base (15, 27, 34, 44) retaining said electrodes, and two of the end portions of the tubes within the base being electrodeless and pinch-sealed;

and wherein said base cooling zone comprises at least one said cooling tube or stub extending through the pinch seal of the electrodeless end portions of an electrodeless tube.

3. A lamap according to claim 2, wherein the cooling tube or stub (16, 28, 36, 48) is melted-in within the respective pinch or press seal through which it extends.

4. A lamp according to claim 1, wherein the base includes a top surface (18), said top surface being formed with at least one air duct outlet opening (19, 42, 50).

5. A lamp according to claim 2, wherein the base includes a top surface (18), said top surface being formed with at least one air duct outlet opening (19, 42, 50), wherein the four tubes are located, in plan view, in square configuration, and the at least one air duct outlet opening (19, 42, 50) is located between the four tubes.

6. A lamp according to claim 1, including a socket (25) adapted to receive the base (27) of the lamp (24), the socket is formed with an air outlet opening (29) matching the location of an air inlet opening (26) formed on the base (27) of the lamp and forming one of said air duct openings;

and wherein the socket is formed with at least one air inlet opening (30, 31) communicating with the air outlet opening (29) therein to provide for continuous air flow from ambient air through the socket and into the base and out of the base at an air outlet opening formed therein and forming part of said air duct openings in the base.

7. A lamp according to claim 6, wherein the base defines a hollow chamber;

the air duct openings include at least one air outlet opening (19, 42, 50) located symmetrically with respect to the tubes of the lamp;

and at least one air inlet opening (17, 26, 49) located non-symmetrically with respect to the tubes, to permit insertion of the lamp into a socket with an air outlet opening in the socket positioned in, respectively, matching or non-matching relation to the air inlet opening in the base.

8. A lamp according to claim 6, wherein the socket (25, 45) includes an air duct tube (52) communicating from an inlet opening (53) in the socket to an outlet (29, 51) thereof.

9. A lamp according to claim 8, wherein the socket is adapted to receive heat-generating circuit components (C);

and said air duct tube (52) includes a heat shield (54) to prevent heating of air being conducted through said tube by said components (C).

10. A lamp according to claim 1, wherein said base (34) is formed with an internal air duct tube (40), coupled to the air inlet opening (39), said air duct tube having an air outlet opening which is located adjacent the closed end of said cooling tube or stub (36).

11. A lamp according to claim 10, wherein auxiliary lamp operating circuit components (C) are provided, located in the base;

and wherein said internal air duct tube (40) includes a heat shield (41) to prevent heating of air being conducted through said tube by said components (C).

12. A lamp according to claim 1, wherein said cooling tube or stub (16, 28, 36, 48) is tipped off at its end remote from the press or pinch seal to form a mercury droplet (23, 32) collection or reservoir zone.

13. A lamp according to claim 12, including means (40, 52) directing air flow to said cooling tube or stub (16, 28, 36, 48) and said mercury droplet collection zone.

14. A lamp according to claim 1, wherein four parallel tubes are provided, two tubes, each, being bent into U-shaped configuration defining said two leg portions and a connecting portion, each one of said leg portions (5, 7) having a respective electrode (12, 13) located therein, and the other of said leg portions (6, 8) being connected to form said continuous discharge vessel;

and at least one of the others of said legs (6, 8) having the closed tube or stub (16) sealed into the pinch or press seal thereof to form the base cooling zone.

* * * * *

UNITED STATES PATENT AND TRADEMARK OFFICE

CERTIFICATE OF CORRECTION

PATENT NO. : 4,694,215

DATED : September 15, 1987

INVENTOR(S) : Dieter HOFMANN

It is certified that error appears in the above-identified patent and that said Letters Patent is hereby corrected as shown below:

Column 9, claim 3, line 1, "lamap" should be -- lamp --

In the abstract: Column 2, line 23, "of" should be -- or --

Signed and Sealed this

Twenty-ninth Day of March, 1988

*Attest:*

DONALD J. QUIGG

*Attesting Officer*

*Commissioner of Patents and Trademarks*